US008162285B2

(12) United States Patent
Rooker

(10) Patent No.: US 8,162,285 B2
(45) Date of Patent: Apr. 24, 2012

(54) NOZZLE SAFETY TRAINING DEVICE

(76) Inventor: Dwayne Rooker, Norfolk, VA (US)

( * ) Notice: Subject to any disclaimer, the term of this patent is extended or adjusted under 35 U.S.C. 154(b) by 994 days.

(21) Appl. No.: 12/156,586

(22) Filed: Jun. 2, 2008

(65) Prior Publication Data

US 2009/0293235 A1 Dec. 3, 2009

(51) Int. Cl.
*B65D 63/00* (2006.01)

(52) U.S. Cl. ..... 251/90; 434/226; 239/526

(58) Field of Classification Search ..... 24/1, 16 R, 24/306, 442; 251/89, 90; 222/153.13, 153, 222/14, 153.1, 153.04, 152, 153.01, 542, 222/546, 558, 562, 567; 239/1, 198, 288; 150/154, 156, 161; 292/253, DIG. 16; 224/42.39, 224/101, 148, 149, 177, 250, 266, 575, 620, 224/901; 434/226, 234; 442/327; 40/299.01; 34/116; 403/404, 179, 51, 7; 285/147.3, 285/148.2, 260; 169/581.1, 52, 24
See application file for complete search history.

(56) References Cited

U.S. PATENT DOCUMENTS

| | | | | |
|---|---|---|---|---|
| 1,133,388 | A * | 3/1915 | Merrill | 40/650 |
| 5,535,928 | A * | 7/1996 | Herring | 224/250 |
| 5,918,807 | A * | 7/1999 | Doss | 239/1 |
| 2005/0156128 | A1* | 7/2005 | Walters, Jr. | 251/90 |

* cited by examiner

*Primary Examiner* — Eric Keasel
*Assistant Examiner* — Time Aigbe
(74) *Attorney, Agent, or Firm* — Bradley D. Goldizen

(57) ABSTRACT

A safety device includes a first loop arranged around a handle of a nozzle. via a first strip of material. A second strip of material extends across the second A second loop is arranged around a body of the nozzle and adjoins the first loop loop. A first strip of material includes a fastener for creating a third loop that prevents a bale of the nozzle from being opened. The safety device may include a visual indicator arranged at a free end of the first strip of material for indicating that a firefighting crew maintaining the nozzle has passed inspection and the type of agent the fire hose expels.

17 Claims, 4 Drawing Sheets

NOZZLE SAFETY TRAINING DEVICE

There are no related patent applications.

This application did not receive any federal research and/or development funding.

TECHNICAL FIELD

Generally, the present invention relates to a safety device used in training firefighters and other damage control personnel. More specifically, the invention is a strap device that attaches to a hose nozzle and prevents a bale of the hose nozzle from being inadvertently opened during training exercises. The strap device comprises a plurality of loops arranged around a handle of the nozzle, the nozzle body and the bale to prevent fire fighting material from being discharged from the nozzle. One or more of the loops may include a fastener means that quickly detaches to decouple the loop from the nozzle part about which it is arranged. The device may also comprise a visual indicator, such as a flag, that is attached to the device to indicate that it has been visually inspected during a training exercise.

BACKGROUND OF THE INVENTION

Damage control and firefighting personnel periodically perform training operations to train for fighting fires. During these training operations, the personnel practice deploying firefighting equipment, such as hose gear and nozzles. In the modern Navy, all sailors are trained in damage control and firefighting operations.

During these training exercises, problems arise when personnel inadvertently open a bale on a nozzle to allow water, foam, or other firefighting agent to flow from the hose nozzle. Currently, many naval personnel use bungee cords, or other such elastic bands, wrapped around the firefighting nozzle during training exercises to prevent inadvertently opening it. Industrial sized paper clips with attached rags are typically utilized to indicate that a hose crew has been inspected. Other problems arise when these bungee cords and paper clips break, are lost, or fall off during the training exercise.

The instant invention overcomes the problems associated with the aforementioned prior art by providing a safety device that prevents the bale from the hose nozzle from being inadvertently opened. A visual indicator device is also provided for assisting inspectors in verifying that a hose crew has been inspected and passed the inspection. Moreover, the safety device may be easily removed by disengaging a detachable loop from the bale. The bale may be operated and the safety device is removed from the hose nozzle.

SUMMARY OF THE INVENTION

A nozzle safety training device includes a plurality of straps, preferably two, arranged around a hose nozzle to prevent the bale from being inadvertently opened during training exercises. An agent test satisfactory indicator is arranged on the device for simulating an agent being expelled from the nozzle during damage control training. The indicator may be a flag of a specific color fastened at an end of the device. For example, a green indictor may simulate salt water agent or a white flag may mean an aqueous filming agent.

The device is preferably formed from a plurality of cloth strips or webbing and preferably includes permanent stitching that fastens the cloth strips together. One of the strips of webbing includes a fastener, preferably of hook and loop material, that forms a dis-engageable or detachable loop which fastens to a bale of a hose nozzle for securing it in a closed or off position. Another loop of material or webbing is arranged at an opposite end of the device for fastening the device to a handle of the hose nozzle. The nozzle includes a flow end that passes through a further loop of material to secure the device to the body of the nozzle.

It is an object of the invention to provide a nozzle safety training strap device that prevents the bale of a nozzle, on which the device has been deployed, from being inadvertently opened during a training exercise.

It is another object of the invention to teach a safety training device that is an agent test satisfactory indicator that shows when a hose crew has passed an inspection.

It is a further object of the invention to provide a safety training device for use in training exercises. The safety training device includes a pair of loops that are connected together via at least one strap. The first loop surrounds a handle on the nozzle handle and the second loop surrounds the body of the nozzle. A strip of material extends from one side of the second loop to the other side to pass across the end of the nozzle from which water or fire fighting agent is expelled or discharged. A third loop includes a fastener and is detachable to allow the third loop to be easily and quickly fastened or coupled to the bale to prevent the nozzle from being accidentally actuated during training exercises. However, the bale third loop may be decoupled from the bale by pulling a loose end to disengage the fastener.

It is another object of the invention to teach a safety training device that is made from common materials such as strips of cloth or webbing that are stitched to create a pair of permanent loops of material for attaching the device to a hose nozzle. A fastener is included for creating a loop that surrounds the bale to prevent it from being inadvertently actuated during a training exercise. In a preferred embodiment, two strips of webbing are used. A permanent loop is formed at one end of a longer strip of webbing via stitching. The second end of the longer strip includes a fastener such as hook and loop material that forms a non-permanent loop. A fastener is also provided at the tip of the second end for securing a visual indicator thererto. The shorter strip of webbing is formed into a circular loop and fastened to the longer strip between the first and second ends. Permanent stitching preferably secures the circular loop to the longer strip.

The above and further objects, details and advantages of the invention will become apparent from the following detailed description, when read in conjunction with the accompanying drawings.

DETAILED DESCRIPTION OF THE INVENTION

Figure 1:
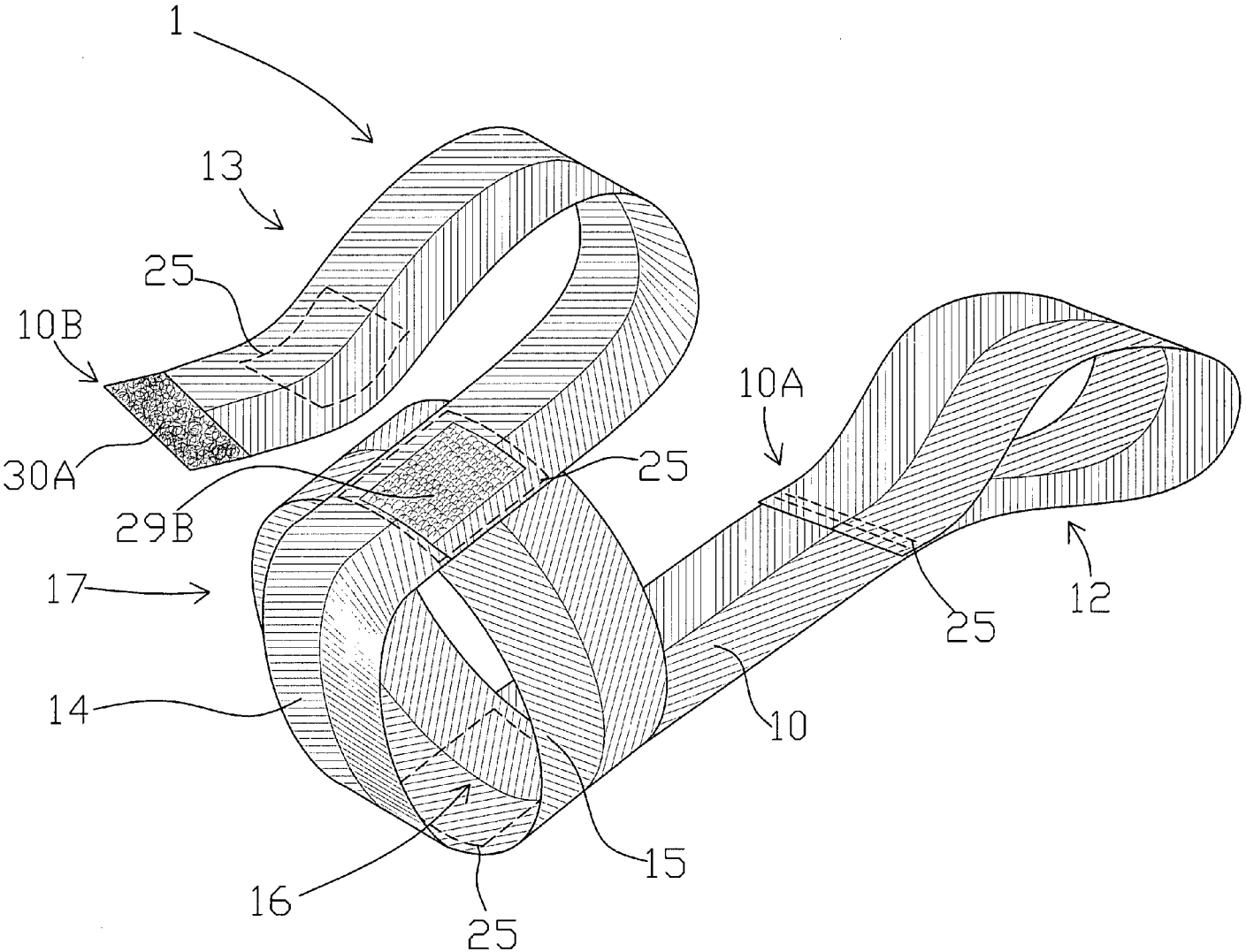
FIG. 1 is a perspective view of the instant invention.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

In a preferred embodiment of the invention, as shown in FIG. 1, the device 1 includes a first strip of material 10 having two ends 10A and 10B . The first strip of material 10 is formed into a first loop 12 via permanent stitching 25 at a first end 10A thereof. The handle 103 of the nozzle 100 is inserted into the first loop 12 of material 10. The second end 10B of the first strip of material 10 includes a fastener 29, having complementary portions 29A and 29B that arranged on respective portions of material 10, as shown in FIG. 2B. These complementary portions 29A, 29B engage one another to create a dis-engageable loop 13 that fastens about the bale 105 of the hose nozzle 100. The second end 10B of the first strip of material 10 is tugged on to detach the dis-engageable loop 13 from the bale 105. A second strip of shorter material 15 is formed in a loop 16. The flow end 101 of the hose nozzle 100 passes through this loop 16 and into a basket end 17 of the device 1 that includes a basket comprising the loop 16 and a basket strip of material 14 that is formed to partially encapsulate flow end 101. The second strip of material 15 is fastened in two places to the first strip of material 10 via permanent stitching 25 using a square pattern as shown. Fastener element 29B is preferably attached on a top end of the material 10 where it overlaps the loop 16. A second set of permanent stitching 25 is provided along a bottom of the loop 16 to secure it to the first strip of material 10. The region of material between these permanent stitching 25 comprises strip of material 14 which encapsulates a portion of flow end 101. As indicated by the drawings, one of the complementary portions 29A, 29B of the fastener 29 is arranged near or atop the area of permanent stitching that couples the first 10 and second 15 strips of materials together. The strips of material may be a nylon webbing, cloth or other such durable material that can be fastened with permanent stitching.

Figure 3:
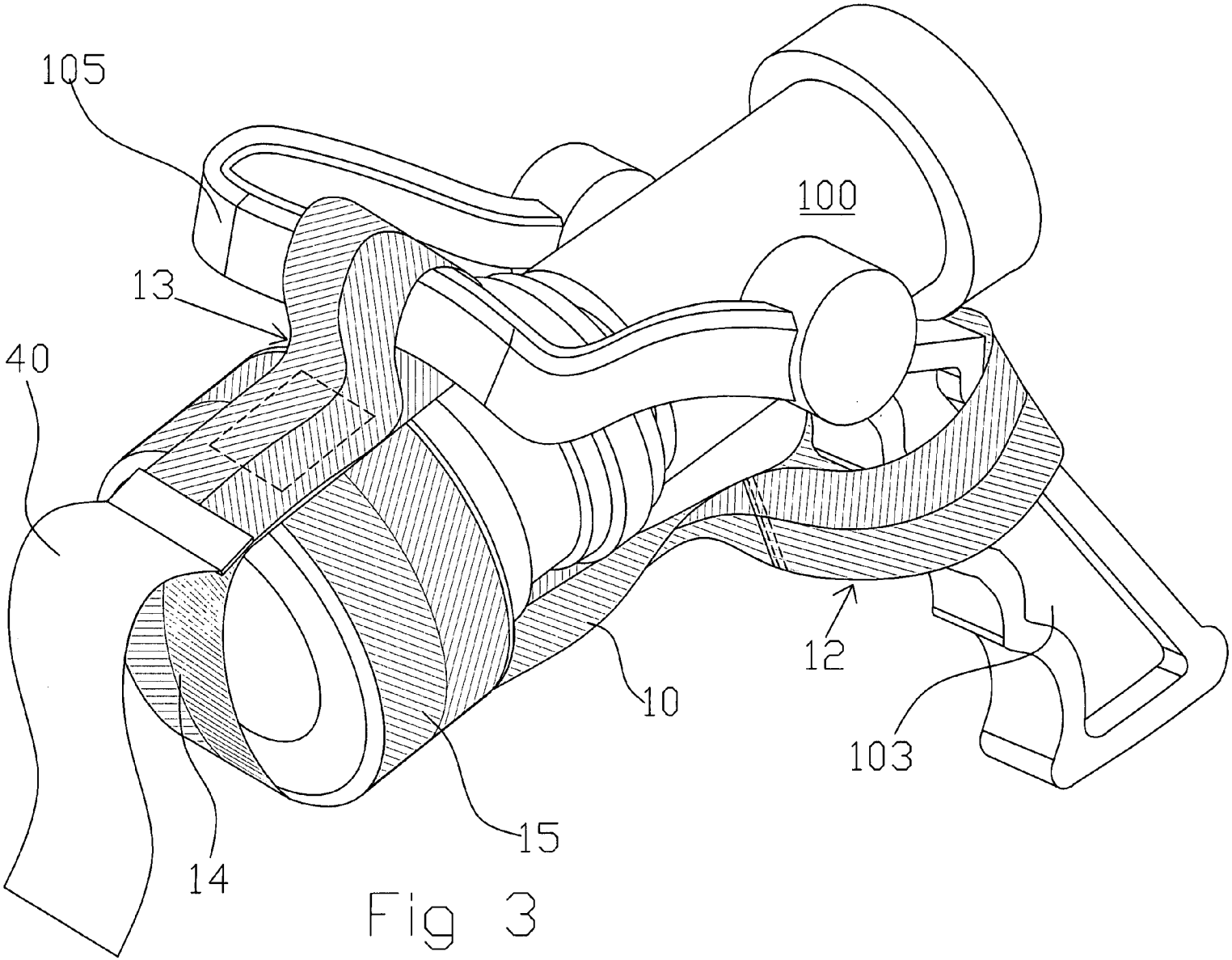
FIG. 3 is a perspective view of the invention on a nozzle and including a visual indicator attached to the device indicating that the hose crew has been inspected.

As indicated, FIG. 1 shows a safety training device 1 that preferably includes a pair of strips of webbing 10, 15 that are formed to include a basket 17 which comprises the loop 16 formed from a shorter strip of material 15 and strip 14 of a longer strip of webbing 10. The flow end 101 of hose nozzle 100 rests within this basket 17 when the hose nozzle 100 is being inspected or when not in use. An indicator flag 40, as shown in FIG. 3, may be included on the second end 10B of the first strip of webbing. The indicator flag includes a complementary strip of fastening material that fastens to fastener strip 30A.

Strip fastener 30A is arranged at the second end 10B of first strip of webbing 10. This end 10B is pulled upwards to separate fastener 29 into complementary portions 29A and 29B. These complementary portions 29A, 29B are permanently fastened to the same face of the material 10 via stitching 25. When mated together, the fastener 29 creates loop 13 that secures about bale 105 to prevent it from being opened, as shown in FIG. 2A.

Permanent stitching 25 that secures complementary fastener 29B to one face of material 10 also preferably secures material 10 to material 15. That is, one half of fastener 29 is arranged directly above where one of material 10, 15 overlaps the other and is permanently stitched together. Permanent stitching 25 is also provided on a bottom of the loop 16 to secure materials 10, 15 together. Another loop 12 is formed at a first end of the material 10, as shown.

Figure 2A:
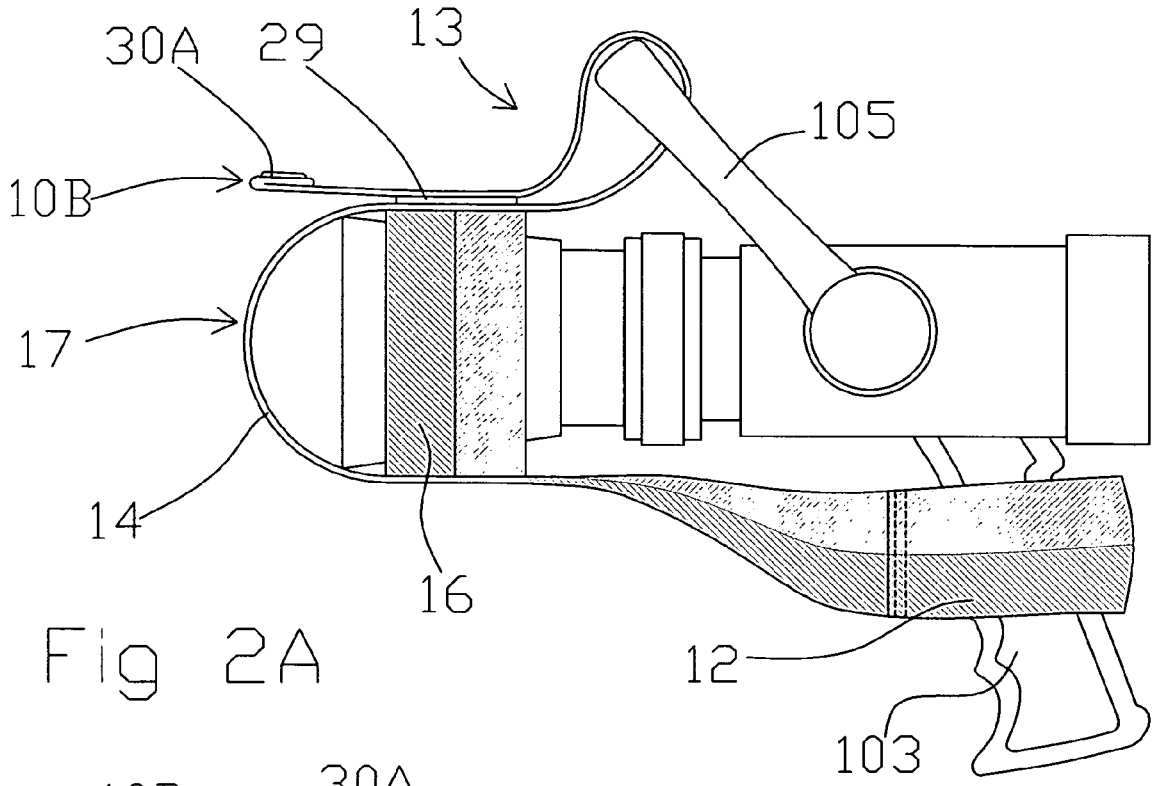
FIG. 2A is a perspective view of the instant invention affixed to a nozzle that is in a closed position.
Figure 2B:
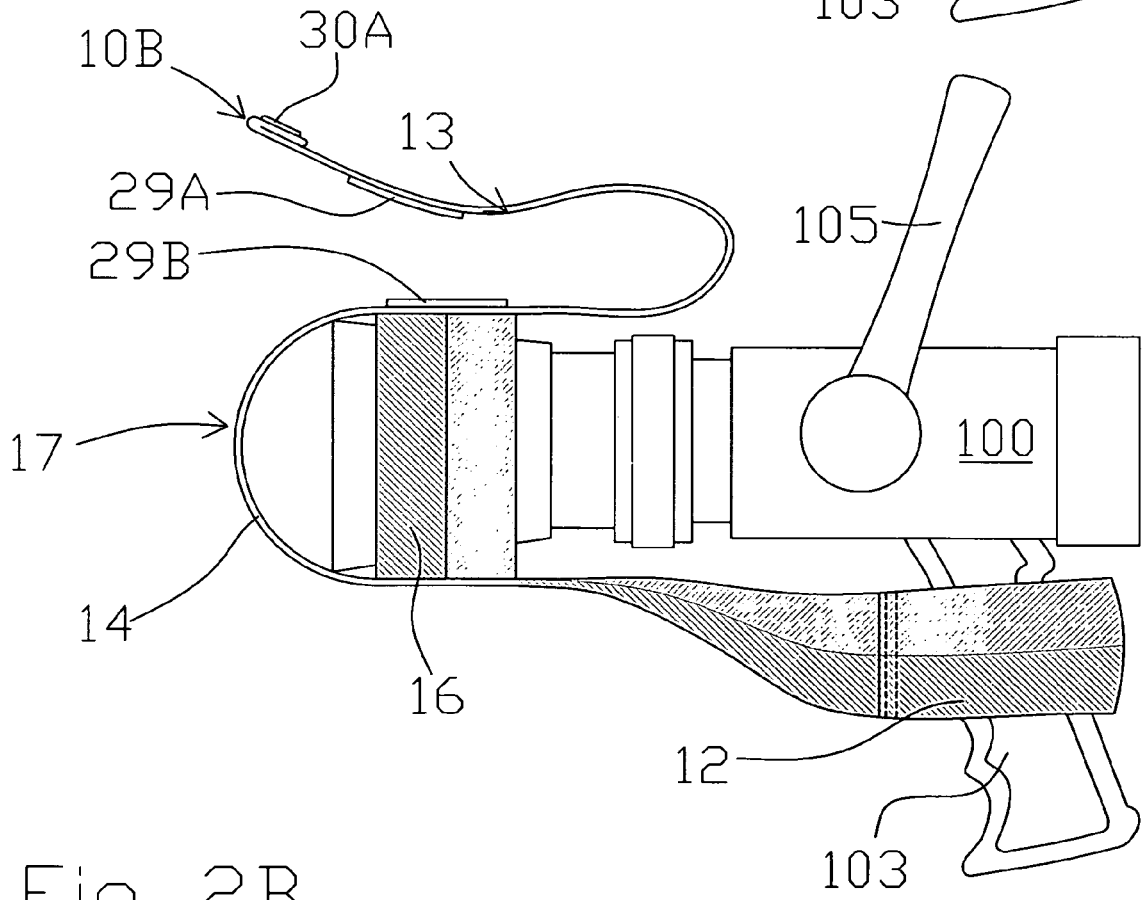
FIG. 2B is perspective view of the instant invention affixed to a nozzle that is in the open position.

As can be understood by FIG. 2A, which is a perspective view of the instant invention affixed to a nozzle that is in a closed position, the device 1 is arranged around a hose nozzle 100. In this instance, the handle 103 is passed through loop 12. Discharge end 101 passes through loop 16 and into basket 17. The second end 10B of material 10 is passed through an opening 102 of the bale 105. The complementary strips 29A, 29B of fastener 29 are brought together to create the detachable loop 13 around bale 105. This loop 13 prevents bale 105 from being inadvertently opened. Loop 13 is disengaged by tugging on end 10B to decouple complementary strips 29A, 29B from one another, as shown in FIG. 2B. Bale 105 may be pulled rearward to allow fire retardant to flow from discharge end 101. As can be understood from FIG. 2B, discharge material will cause basket 17 to be removed from discharge end 101. The operator can then slip loop 12 downward and away from handle 103.

FIG. 3 is a perspective view of the invention 1 on a nozzle 100 and including a visual indicator 40 attached to the device 1 indicating that the hose crew has been inspected. In this instance, the visual indicator 40 includes a complementary fastener strip 30B (not shown) that mates with fastener strip 30A to couple the visual indicator 40 to the second end 10B of material 10. Visual indicator 40 may be provided in a variety of colors. The visual indicator is used as an agent test satisfactory indicator and is arranged on the device for simulating an agent being expelled from the nozzle during damage control training. The visual indicator may be a flag of a specific color fastened at an end of the device. For example, a green indictor may simulate salt water agent or a white flag may mean an aqueous filming agent. Other identification indicia may be provided on each visual indicator.

Figure 4A:
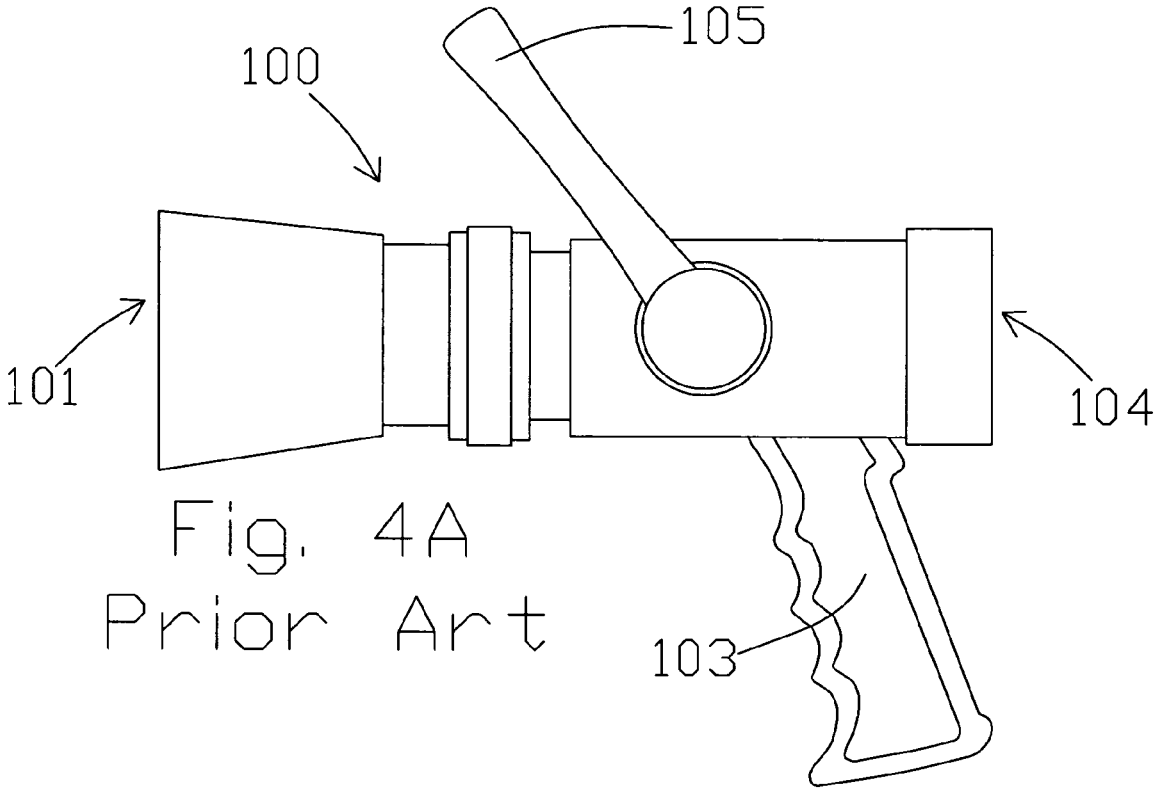
Fig. 4A Prior Art
FIG. 4A is a prior art nozzle in the closed position.
Figure 4B:
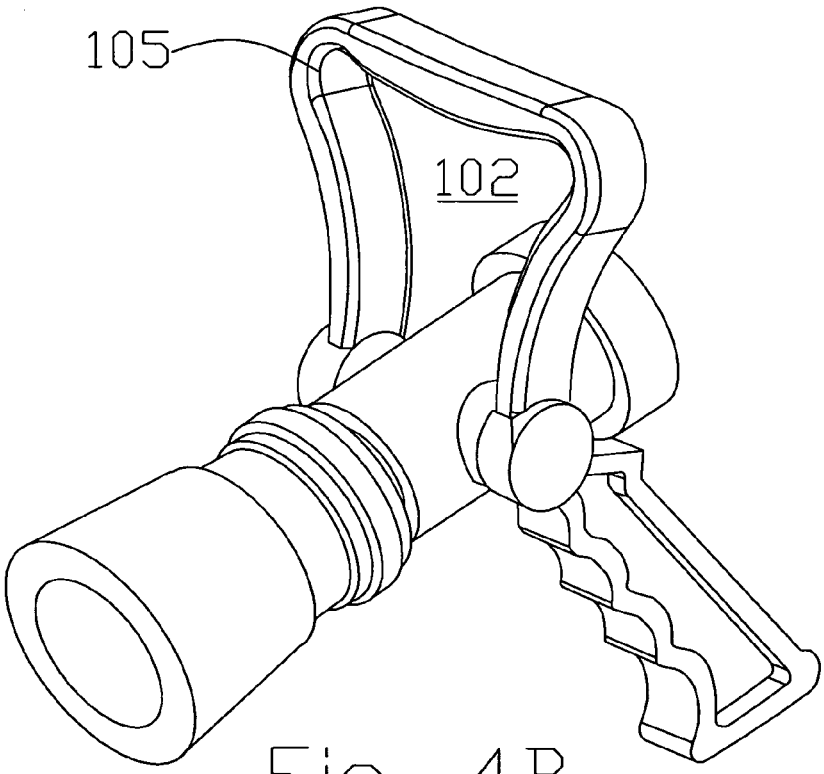
Fig. 4B Prior Art
FIG. 4B is a prior art nozzle in the open position.

FIG. 4A is a prior art nozzle in the closed position. FIG. 4B is a prior art nozzle in the open position. In FIG. 4B, the nozzle 100 includes a discharge end 101 that discharges fire retardant material (not shown) when the bale 105 is forced rearward away from the discharge end 101. A hose end 104 is coupled to a hose that provides pressurized fire retardant that flows through nozzle 100. In FIG. 4A, the bale 105 is shown in the open position to correspond with FIG. 2A when the device 1 is typically installed on the hose nozzle 100. The body of the nozzle includes that part of the nozzle to which the bale 105 and the handle 103 attach. A valve is arranged within the body to be closed when the bale 105 is in a defined position such as the forward position shown when the nozzle is in the closed position.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. A safety device that prevents accidental discharge of a fire retardant through a nozzle having a body and a bale for allowing the fire retardant to flow through the nozzle, said nozzle being attached to an end of a hose and including a first end that attaches to the hose and a second end for expelling the fire retardant from the hose, said safety device comprising:

a first strip of webbing having a first end and a second end and a center defined substantially at a midpoint between the first and second ends, said first end formed in a first loop of webbing and that accepts a handle of the nozzle, said second end comprising a fastener that forms a second loop of webbing that surrounds the bale of the nozzle to maintain the nozzle in a closed position; and, a second strip of webbing formed in a loop by permanent stitching and being fastened substantially near the center of the first strip of webbing, having a top side and a bottom side that surrounds the body of the nozzle, said top side being fastened with permanent stitching to the first strip of webbing between the center and the second end of the first strip of webbing, said bottom side being fastened with permanent stitching to the first strip of webbing between the center and the first end of the first strip of webbing.

2. The safety device of claim 1 wherein said first end of said first strip of webbing is formed in a first loop of material by permanent stitching.

3. The safety device of claim 1 wherein material of the first strip of webbing substantially near the center and between the permanent stitching that secures the first strip of webbing to the second strip of webbing and the second strip of webbing create a basket that surrounds the second end of the hose nozzle that expels fire retardant.

4. The safety device of claim 1 wherein said second loop arranged substantially near the second end of the first strip of webbing is formed by a fastener which disengages to decouple the second loop from the bale of the nozzle.

5. The safety device of claim 4 wherein said fastener comprises a pair of hook and loop material strips, one strip of the hook and loop material being arranged atop the first strip of webbing where the first strip of webbing fastens to the top of the loop formed by the second strip of webbing.

6. The safety device of claim 1 further comprising a first complementary fastening strip arranged substantially near the second end of the first strip of webbing to mate with a second complementary strip of material arranged on the same face of the first strip of webbing as the first complementary fastening strip, said second complementary fastening strip being arranged substantially near where the first strip of webbing fastens to the second strip of webbing at a top of the loop formed by the second strip of webbing.

7. The safety device of claim 1 further including a visual indicator that couples to the second end of the first strip of webbing via a fastener.

8. The safety device of claim 7 further comprising at least two visual indicators that are interchanged to indicate after inspection the type of fire retardant or agent the hose expels.

9. The safety device of claim 7 wherein said fastener comprises a pair of fastening strips, one fastening strip arranged on the visual indicator the other fastening strip arranged on the second end of the first strip of webbing.

10. A safety device used for practicing damage control and fire fighting techniques, said safety device comprising:

a first strip of material having a permanent loop arranged at one end, said permanent loop accepts a handle of a nozzle that expels fire retardant material;

a second fixed loop of material that surrounds a body of the nozzle and through which a discharging end of the nozzle extends, said second fixed loop of material fastened to the first strip of material to create a basket that substantially contains the discharge end of the nozzle; and, a third loop of material arranged at a second end of the first strip of material and extending through a bale of the nozzle and preventing the bale from being operated when the safety device is fastened to the nozzle.

11. The safety device of claim 10 wherein said first strip of material fastens to the bottom side of the second loop of material and extends to the top side of the second loop of material and fastens thereto, said first strip of material extending across the discharging end of the nozzle.

12. The safety device of claim 10 wherein said first end is formed in the first loop of material by permanent stitching.

13. The safety device of claim 10 wherein material of the first strip of material substantially near a center and between permanent stitching that secures the first strip of material to the second strip of material and the second strip of material creates a basket that surrounds the discharging end of the hose nozzle that expels fire retardant.

14. The safety device of claim 10 wherein said third loop of material is arranged substantially near the second end of the first strip of material and is formed by a fastener that disengages to decouple the third loop from a bale of the nozzle.

15. The safety device of claim 14 wherein the fastener that forms the third loop of material comprises a pair of hook and loop material strips, one strip of the hook and loop material being arranged atop the first strip of material where the first strip of material fastens to the top of the second loop.

16. The safety device of claim 10 further comprising a first complementary fastening strip arranged substantially near the second end of the first strip of material to mate with a second complementary strip of fastening material arranged on the same face of the first strip of material as the first complementary fastening strip, said second complementary fastening strip being arranged substantially near where the first strip of material fastens to the second strip of material at a top of the loop formed by the second strip of material.

17. The safety device of claim 10 further including a visual indicator that couples to the second end of the first strip of material via a fastener.

* * * * *